US006945772B2

(12) United States Patent
Chang

(10) Patent No.: US 6,945,772 B2
(45) Date of Patent: Sep. 20, 2005

(54) CHILD RESISTANT DISPOSABLE LIGHTER

(76) Inventor: Ming-Yu Chang, 2240 E. Washington Blvd., Los Angeles, CA (US) 90021

( * ) Notice: Subject to any disclaimer, the term of this patent is extended or adjusted under 35 U.S.C. 154(b) by 0 days.

(21) Appl. No.: 10/121,827

(22) Filed: Apr. 12, 2002

(65) Prior Publication Data

US 2003/0194669 A1 Oct. 16, 2003

(51) Int. Cl.[7] ..... F23D 11/036; F23Q 7/024; F23Q 2/05; F23Q 4/046

(52) U.S. Cl. ..... 431/153; 431/277

(58) Field of Search ..... 431/277, 153, 431/273, 276; D27/158, 159, 156, 141, 157

(56) References Cited

U.S. PATENT DOCUMENTS

| | | | | | |
|---|---|---|---|---|---|
| 2,978,889 | A | * | 4/1961 | Atchley | 431/152 |
| 3,063,276 | A | * | 11/1962 | Cassan | 431/254 |
| 3,150,507 | A | * | 9/1964 | Smith | 431/125 |
| 3,465,355 | A | * | 9/1969 | Van Poppel | 431/126 |
| D229,712 | S | * | 12/1973 | Vogel | D27/156 |
| 3,860,385 | A | * | 1/1975 | Nakanishi | 431/344 |
| 3,938,942 | A | * | 2/1976 | Torassa | 431/142 |
| D243,702 | S | * | 3/1977 | Sherman | D27/156 |
| 4,749,351 | A | * | 6/1988 | Mahoney | 431/252 |
| D308,732 | S | * | 6/1990 | Ichikawa | D27/156 |
| 5,882,186 | A | * | 3/1999 | Kai Man | 431/153 |
| 5,897,307 | A | * | 4/1999 | Chang | 431/153 |
| 6,000,932 | A | * | 12/1999 | Willet | 431/125 |
| D425,656 | S | * | 5/2000 | Aronson, II | D27/141 |
| 6,123,541 | A | * | 9/2000 | Yang | 431/153 |
| D434,179 | S | * | 11/2000 | Yang | D27/161 |
| D451,239 | S | * | 11/2001 | Abouni | D27/156 |
| D464,771 | S | * | 10/2002 | Kurokawa et al. | D27/156 |
| D465,065 | S | * | 10/2002 | Nakamura | D27/156 |

FOREIGN PATENT DOCUMENTS

| | | | | |
|---|---|---|---|---|
| CH | 231 756 | * | 7/1944 | 431/277 |
| DE | 2 264 055 | * | 7/1973 | 431/276 |
| FR | 748 874 | * | 7/1933 | 431/129 |
| FR | 2 499 680 | * | 8/1982 | 431/153 |
| GB | 1 108 150 | * | 4/1968 | 431/277 |
| GB | 1 348 292 | * | 3/1974 | |
| JP | 51-115160 | * | 10/1976 | |

* cited by examiner

*Primary Examiner*—Carl D. Price
(74) *Attorney, Agent, or Firm*—Raymond Y. Chan; David and Raymond

(57) ABSTRACT

A child resistant disposable lighter includes a shielding frame including a U-shaped frame body and a pair of shielding guards. The frame body, which is mounted on a supporting frame, has two sidewalls positioned at two outer sides of the supporting walls respectively. Each sidewall of the frame body has a slanted top edge rim extended tangentially with respect to each respective driving wheel to encircle a front portion thereof. Each shielding guard is integrally extended from the two sidewalls of said frame body and defined an ignition cavity between the two shielding guards to rotatably receive the driving wheels in the ignition cavity. A center of each shielding guard is positioned eccentrically to a center of the respective driving wheel so as to position at least the front and top portions of the driving wheels below the shielding guards to prevent a child to ignite the lighter.

31 Claims, 7 Drawing Sheets

CHILD RESISTANT DISPOSABLE LIGHTER

BACKGROUND OF THE PRESENT INVENTION

1. Field of Invention

The present invention relates to a disposable lighter, and more particularly to a child resistant disposable lighter which comprises a shielding frame for shielding the striker wheel therein so as to prevent the disposable lighter from being ignited accidentally or by children.

2. Description of Related Arts

Modern butane lighters have become very popular, especially the flint type disposable lighters, since the lighters are economy, cheap and easy operation. Due to the safety purpose, both the government and the consumers in United States demand a safety device employed in every lighter to prevent unwanted ignition accidentally or by a child. Most of the disposable lighters are employed with a safety lock that normally locks up a depression of the gas releasing button of the disposable lighter so as to prevent the disposable lighter from unwanted ignition. However, the structure of such safety lock is more complicated that highly increases the manufacturing cost of the disposable lighter. Furthermore, not all the countries require the lighter to employ with the safety device such that it is not economy for the manufacturer to make the lighters to fit both the markets whether the markets require the safety device or not.

U.S. Pat. No. 6,123,541, owned by Yang, generally suggests a safety windshield comprising a pair of safety shells integrally extended from two sides of a frame body to coaxially encircle two outer sides of two driving wheels respectively in such a manner that the safety shells form a physical barrier to prevent a thumb of a child from fully engaging with the driving wheels, as shown in FIG. 1. Moreover, the '541 patent requires a radius of each safety shells being slightly larger than that of the driving wheel. However, practically speaking, the child's fingers have a smaller size that when a little child use his or her finger of one hand, such as his or her left hand thumb, to press down the gas lever, the child is still free to independently press a litter finger tip of him or her another hand, such as the index finger of his or here right hand, into the safety shells' top front opening positioned close to the gas nozzle and able to deform his or her finger tip's muscle to reach the driving wheels and frictionally engage with the driving wheels, as shown in FIG. 1B. Practically, since there is a particular room between the thumb and the index finger, once the child's finger can rotate the driving wheels for about a one-third to half the circumferential length thereof, the disposable lighter can be ignited. Which not only may cause unexpected accident but also may burn the child's finger because the position where the finger is pressed on the safety shells is closed to the gas nozzle where the flame released.

Moreover, the measurement of the safety shells must be precise during the manufacturing process. When the radius of each safety shell is too large, even an adult may fail to deform his or her thumb to frictionally engage with the driving wheels in order to ignite the disposable lighter. When the radius of each safety shell is too small such as smaller than that of the driving wheel, the safety shells fail to well encircle the driving wheels and lose their safety purpose as the safety windshield.

SUMMARY OF THE PRESENT INVENTION

A main object of the present invention is to provide a child resistant disposable lighter which comprises a shielding frame encircling at least a top portion of each of the driving wheels for forming a physical barrier for rotation the driving wheels so as to prevent the child resistant disposable lighter from being ignited accidentally or by children.

Another object of the present invention is to provide a child resistant disposable lighter, wherein two outer sides of the driving wheels are non-coaxially covered by two shielding guards, so as to enhance the frictionally engagement between the adult's thumb and the driving wheels for igniting the child resistant disposable lighter.

Another object of the present invention is to provide a child resistant disposable lighter, wherein the shielding frame is adapted to mount on all kinds of disposable lighter. so as to provide a child resistant feature for any disposable lighter. In other words, the shielding frame is a universal frame that the manufacturer is able to make the shielding frame to fit all the markets whether the disposable lighter requires the safety feature or not.

Another object of the present invention is to provide a child resistant disposable lighter that does not require altering its original structural design, so as to minimize the manufacturing cost of incorporating the shielding frame with every conventional disposable lighter that has a conventional striker wheel.

Accordingly, in order to accomplish the above objects, the present invention provides a child resistant disposable lighter, which comprises:

a lighter body having a gas reservoir;

a supporting frame, which is sealedly mounted on the lighter body, comprising a first and a second supporting wall parallely and longitudinally extended from two sides of the supporting frame, the supporting frame further having a vertical spring chamber provided between the first and second supporting walls;

a spring being received in the spring chamber;

a gas lever being pivotally mounted between the first and second supporting walls and having a front lifting end and a depressible end;

a gas nozzle upwardly extended from the gas reservoir at a position above the supporting frame, the gas nozzle being engaged with the lifting end of the gas lever in such a manner that when the depressible end of the gas lever is pushed downwardly, the lifting end of the gas lever pivotally lifts up the gas nozzle to release gas from the gas reservoir through the gas nozzle;

an ignition device, which comprises a flint having a bottom portion inserting into the spring chamber and being supported by the spring, a striker wheel having a circumferential coarse striking surface positioned right above the flint being rotatably mounted between the first and second supporting walls, and two driving wheels, each having a diameter larger than a diameter of the striker wheel, coaxially and integrally attached at two sides of the striker wheels respectively and arranged in such a manner that when the driving wheels are rotated, the striker wheel is driven to rotate and strike against the flint to produce sparks towards the gas nozzle; and a shielding frame, comprising:

a U-shaped frame body, which is mounted on the supporting frame, having two sidewalls positioned at two outer sides of the supporting walls respectively, wherein each sidewall of the frame body has a slanted top edge rim extended rearwardly and tangentially with respect to each of the driving wheels, so as to encircle a front portion of the outer side of the respective driving wheel; and a pair of shielding guards, each of which has an arc-shaped, integrally extended from the two sidewalls of the frame body and defined an ignition cavity between the two shielding guards to rotatably received the driving wheels in the ignition cavity, wherein a center of each of the shielding guards is positioned offset to a center of the respective driving wheel in such a manner that a manipulation portion of each driving wheel is defined at a position that the respective driving wheel is extended out of the ignition cavity at a rear side thereof, thereby, a user is able to apply a rotational force on the manipulation portions of driving wheels in order to drive the striker wheel to rotate so as to ignite the child resistant disposable lighter.

DETAILED DESCRIPTION OF THE PREFERRED EMBODIMENT

Figure 2:
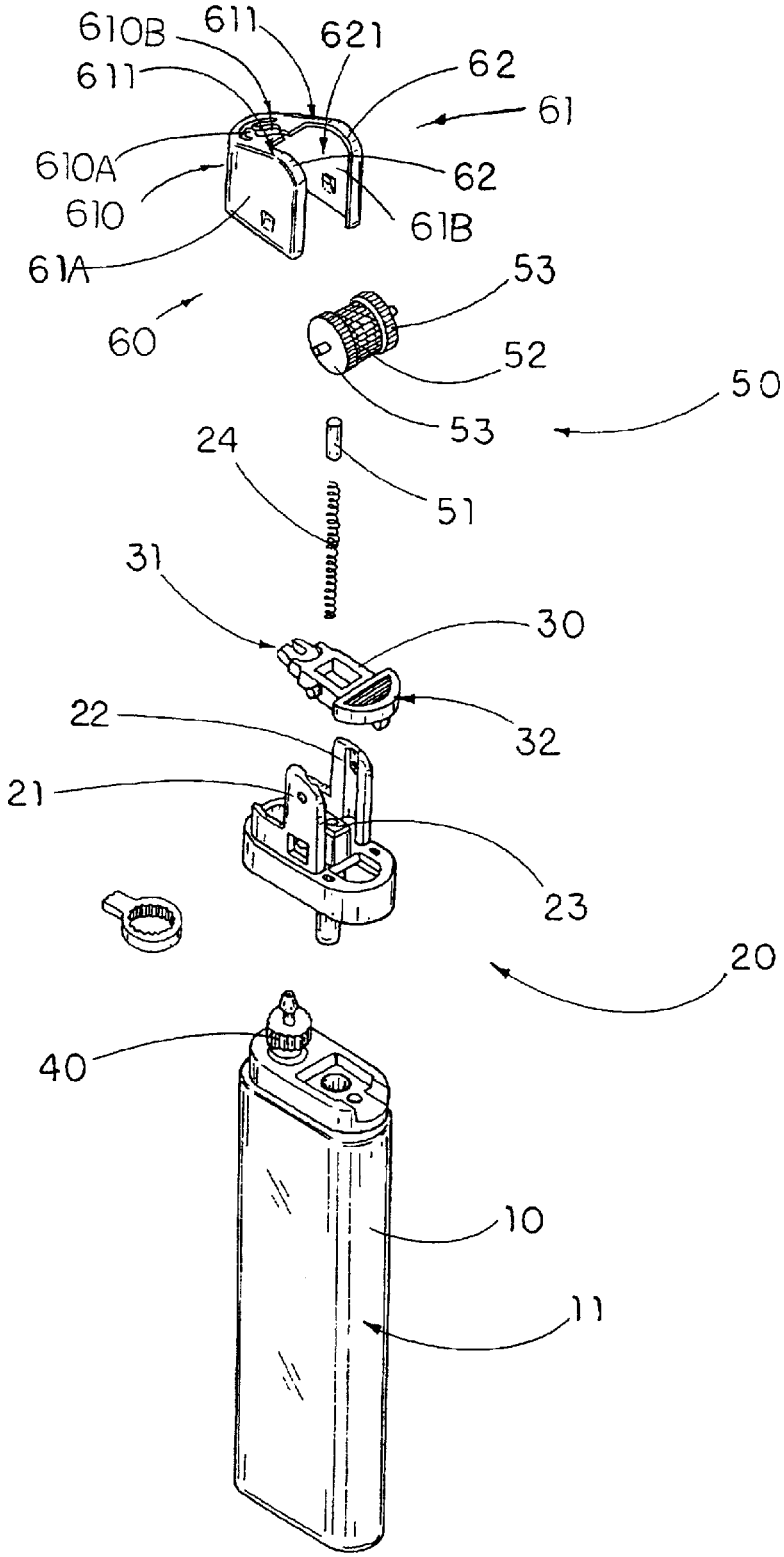
FIG. 2 is an exploded perspective view of a child resistant disposable lighter according to a preferred embodiment of the present invention.
Figure 3:
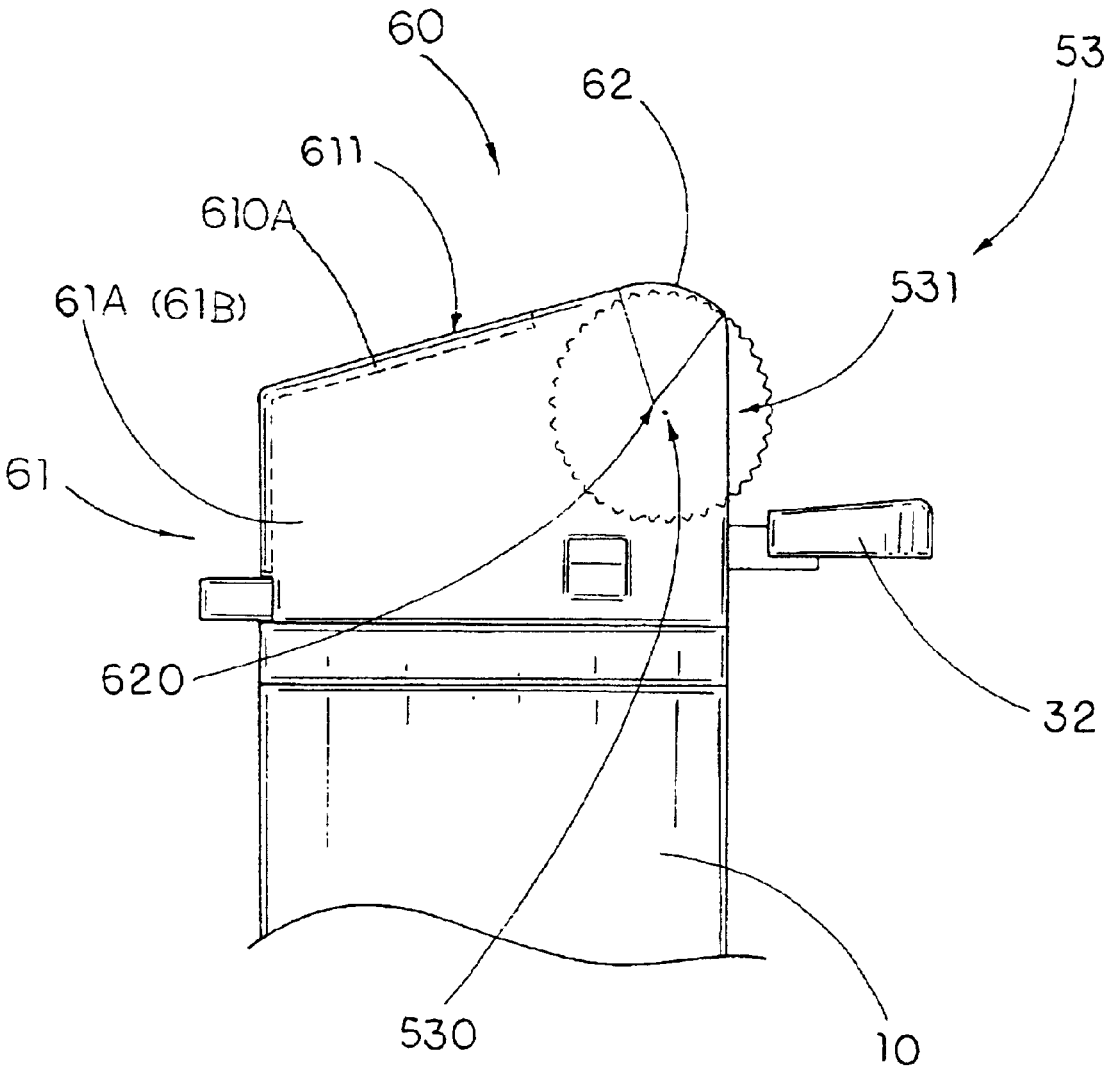
FIG. 3 is a sectional view of a shielding frame of the child resistant disposable lighter according to the above preferred embodiment of the present invention.
Figure 4:
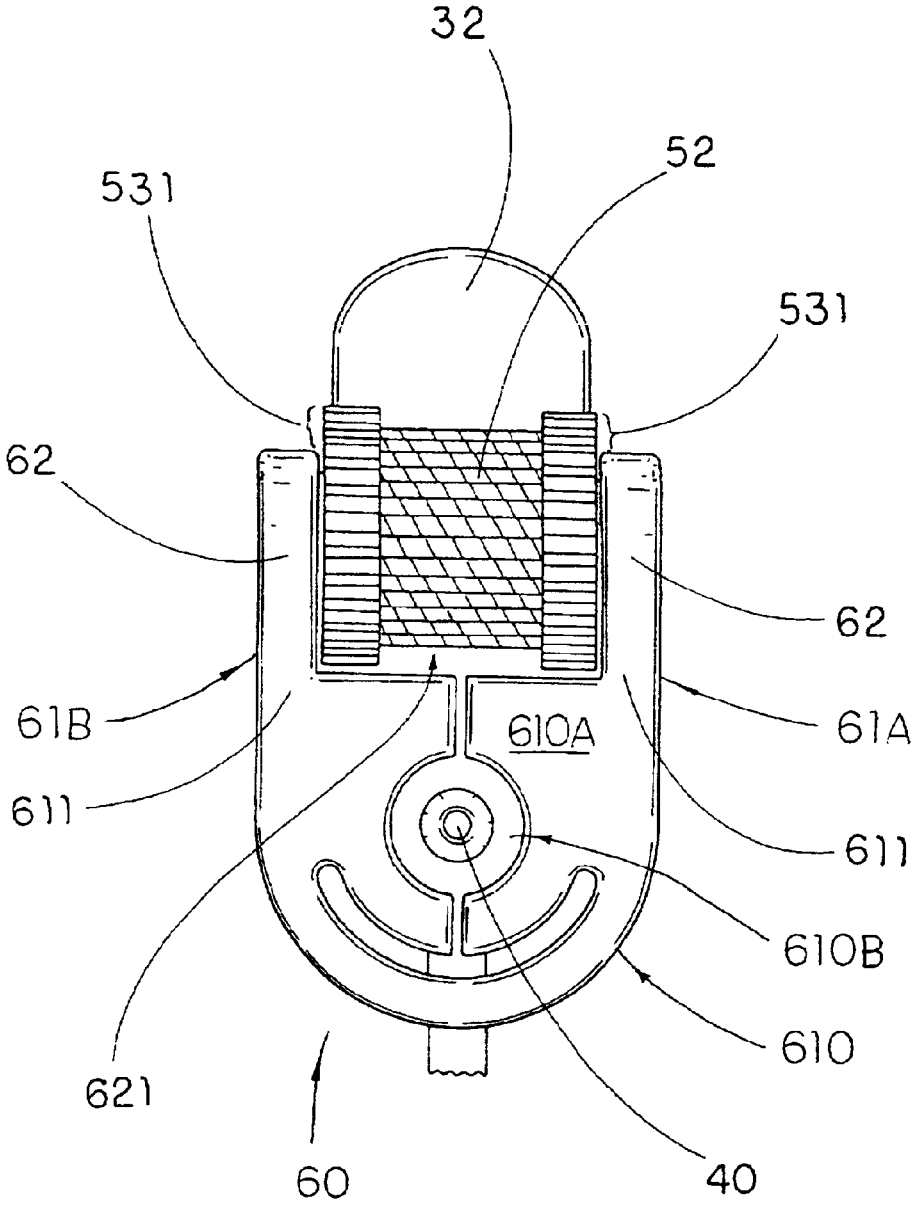
FIG. 4 is a top view of the child resistant disposable lighter according to the above preferred embodiment of the present invention.

Referring to FIGS. 2 to 4 of the drawings, a child resistant disposable lighter according to a preferred embodiment of the present invention is illustrated, wherein the child resistant disposable lighter, such as a conventional disposable lighter, comprises a lighter body 10 having a gas reservoir 11, and a supporting frame 20, which is sealedly mounted on the lighter body 10, comprising a first and a second supporting wall 21, 22 parallely and longitudinally extended from two sides of the supporting frame 20. The supporting frame 20 further has a vertical spring chamber 23 provided between the first and second supporting walls 21, 22.

The child resistant disposable lighter further comprises a spring 24 being received in the spring chamber 23, a gas lever 30 being pivotally mounted between the first and second supporting walls 21, 22 and having a front lifting end 31 and a depressible end 32, and a gas nozzle 40 being upwardly extended from the gas reservoir 11 to a position above the supporting frame 20. The gas nozzle 40 is engaged with the lifting end 31 of the gas lever 30 in such a manner that when the depressible end 32 of the gas lever 30 is pushed downwardly, the lifting end 31 of the gas lever 30 pivotally lifts up the gas nozzle 30 to release gas from the gas reservoir 11 through the gas nozzle 40.

An ignition device 50 comprises a flint 51 having a bottom portion inserted into the spring chamber 24 and being supported by the spring 24, a striker wheel 52 having a circumferential coarse striking surface positioned right above the flint 51 and being rotatably mounted between the first and second supporting walls 21, 22, and two driving wheels 52, each having a diameter larger than a diameter of the striker wheel 52, coaxially and integrally attached at two sides of the striker wheel 52 respectively and arranged in such a manner that when the driving wheels 53 are rotated, the striker wheel 52 is driven to rotate and strike against the flint 51 to produce sparks towards the gas nozzle 40.

As shown in FIGS. 2 and 3, the child resistant disposable lighter further comprises a shielding frame 60 which comprises a U-shaped frame body 61 mounted on the supporting frame 20. The frame body 61 has two sidewalls 61A, 61B positioned at two outer sides of the supporting walls 21, 22 respectively. Two front ends of the two sidewalls 61A, 61B inwardly curved to meet and form a gas shelter 610 to surround the gas nozzle 40 and shelter the root of the flame released from the gas nozzle 40.

A top edge of each sidewall of the frame body 61 bends inwardly to form a slanted top edge rim 611 extended from a front end rearwardly, upwardly and tangentially to a rear end thereof with respect to each of the driving wheels 53. As shown in FIG. 4, front portions of the two slanted top edge rims 611, for some disposable lighter, inwardly extend to form a shelter top 610A having a flame opening 610B thereon to cover and encircle a front portion and a bottom portion of the respective driving wheel 53.

Rear portions of the two slanted top edge rims 611 which continuously extend from the shelter top 610A and two rear portions of the sidewalls 61A, 61B form two shielding guards 62 each of which encircles and covers a bottom portion and a top portion of the outer side of the respective driving wheel 53.

According to the preferred embodiment of the present invention, a rear portion of each of the two slanted top edge rims 611 is curved to have an arc-shaped to better encircle the top portion of the outer side the of respective driving wheel 531. An ignition cavity 621 is defined between the two shielding guards 62 to rotatably receive the driving wheels 53 therein, wherein a center 620 of each of the shielding guards 62 is positioned eccentrically to a center 530 of the respective driving wheel 53 in such a manner that the centers 530 of the driving wheels 53 is preferred to be allocated behind and/or below the centers 620 of the shielding guards 62 so as to ensure the front portions and the top portions of the two driving wheels 53 are positioned below the two slanted top edge rims 611 to prevent a child's finger from contacting with the periphery edges of the driving wheels 53.

According to the preferred embodiment, the slanted top edge rim 611 of each shielding guard 62 of each sidewall 61A, 61B of the frame body 61 is upwardly, rearwardly and inclinedly extended to form a predetermined slope tangentially to the respective sidewall 61A, 61B in such a manner that the two slanted top edge rims 611 of the frame body 61 function as a physical barrier to especially prevent a finger of a child from engaging with the front portions of the driving wheels 53.

By means of the eccentric arrangement of the centers 530, 620 of the driving wheels 53 and the shielding guards 62, each of the shielding guards 62 can be made to have a radius equal to a radius of the respective driving wheel 53. Thus, preferably, the center 530 of each driving wheel 53 is positioned behind the center 620 of the respective shielding guard 62 in such a manner that the shielding guards 62 substantially encircle and cover the front portions, the bottom portions and the top portions of the outer sides of the two driving wheels 53 while rear portions of the driving wheels 53 form manipulation portions 531 (i.e. about one-fourth or less than one-fourth of the circumferential length of the driving wheel) of the two driving wheels 53, which are protruded from the rear side of the ignition cavity 621.

Figure 1A:
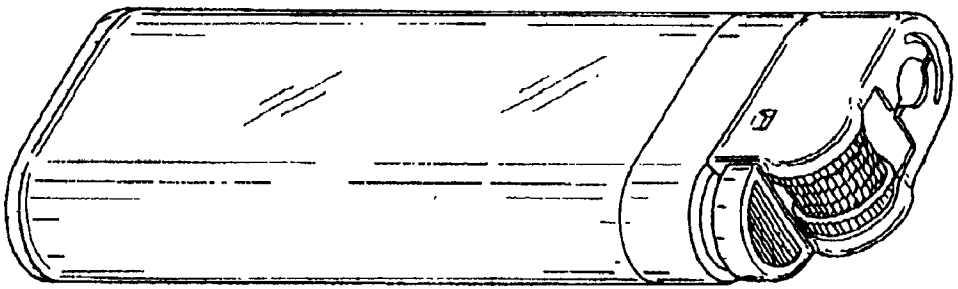
FIG. 1A PRIOR ART
FIG. 1A is a perspective view of a conventional disposable lighter having a safety windshield.
Figure 1B:
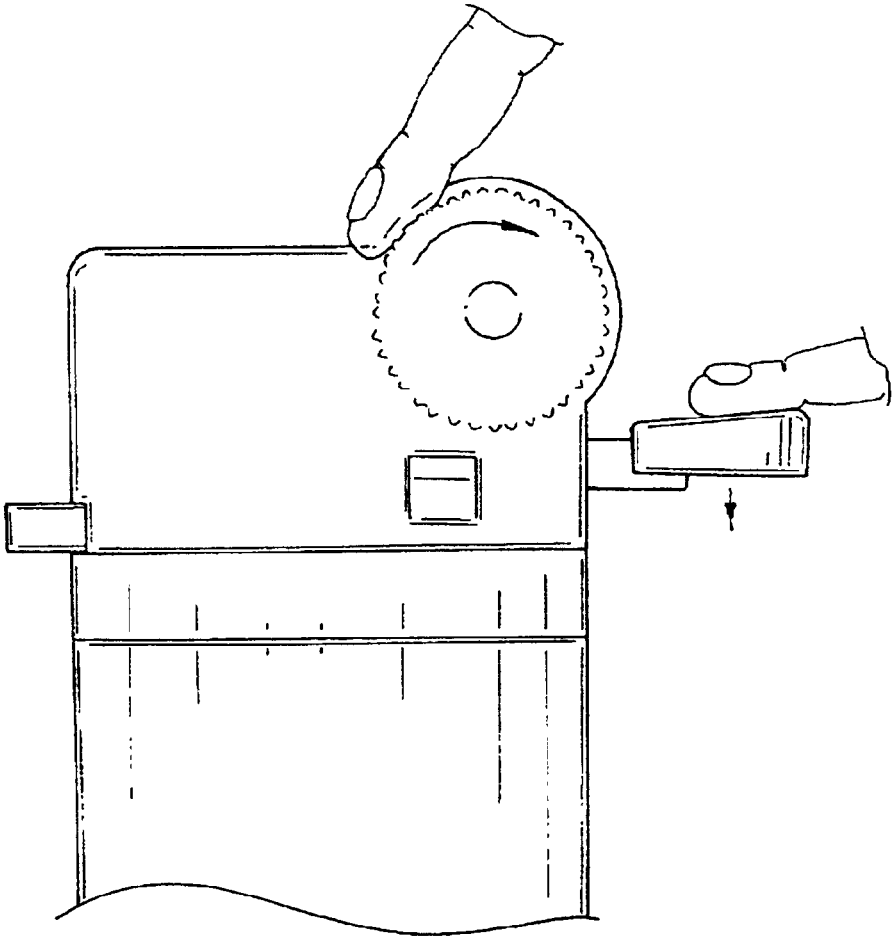
FIG. 1B PRIOR ART
FIG. 1B is a side view of the conventional disposable lighter.

The reason of doing this is that, referencing to FIG. 1B, when the front and top portions of the driving wheels 53 are encircled by the shielding frame 60, a child's finger tip is blocked by the slanted top edge rims 611 of the shielding frame 60 so that the child is unable to make finger contact with the front top portions of the two driving wheels 53 to rotate the driving wheels. However, since the manipulation portions 531 of the driving wheels 53 are adjacent to the gas lever 32, there is no room for the child to use both hands to ignite the lighter as shown in FIG. 1B, while the child's thumb does not have the power and strength to press down the gas lever 32 and strike such short manipulation portions 531 to provide sparks to ignite the lighter in such a short and tight operation space. However, while an adult's finger is able to drive the driving wheels 53 from their top portions to that manipulation portions 531 to produce sparks, the manipulation portions 531 substantially provide a better and solid contact of the adult's driving finger with the driving wheels 53 at the last second before pressing on the gas lever 32 so as to ensure the ignition operation.

It is worth to mention that by means of the eccentric arrangement, even the driving wheels 53 are made slightly smaller than the size of the shielding guards 62, the shielding frame 60 still functions well to prevent the children from finger contact with the front portion and the top portion of the driving wheels 53 to ensure the child safety while having less burden of size matching problems.

According to the present invention, the slanted top edge rims are smooth surfaces provided above the top portion of the driving wheels 53 to block any unwanted rotation of the driving wheels 53 so as to prevent the disposable lighter from being accentually. Moreover, even though the children may try to ignite the child resistant disposable lighter by rotating the driving wheels 53 along a scrubbing surface such as the floor while pushing down the driving wheels 32, the smooth slanted top edge rims 611 substantially shelter the driving wheels 53 from contact with the scrubbing surface, so as to prevent any rotational movement of the driving wheels 53.

As mentioned above, preferably, the center 530 of each driving wheel 53 is positioned slightly below the center 620 of the respective shielding guard 62 so that top edges of the driving wheels 53 are ensured to be positioned below the rear portions of the smooth slanted top edge rims 611 of the shielding guards 62, so that top portions of the outer sides of the driving wheels 53 are fully covered by the shielding guards 62.

According to the embodiment as shown in FIG. 3, a rear end of each of the shielding guards 62 is a vertical wall that enables a rear chord portion of each of the driving wheels 53 being exposed out of the ignition cavity 621 of the shielding frame 60 so as to define the manipulation portion 531 of each driving wheel 53.

In order to ignite the child resistant disposable lighter, the adult's thumb must apply a sufficient pressure on the top portions of the shielding guards 62 to deform his or her thumb surface into the ignition cavity 621 so as to frictionally engage with the top portions of the driving wheels 53. Then, a rotational force is applied on the driving wheels 53 rearwardly and downwardly to drive the striker wheel 52 to rotate, so as to strike against the flint 51 to produce sparks towards the gas nozzle 40. At the same time, the depressible end 32 of the gas lever 30 is depressed downwardly to lift up the gas nozzle 40 for releasing gas which is ignited by the sparks. Since the manipulation portions 531 of the driving wheels 53 are exposed out of the ignition cavity 621, the adult's thumb can easily engage with the driving wheels 53 to maintain continuous rotation of the striker wheel 52 while depressing the gas lever 32. As stated above, the rotational distance of the manipulation portion 531 of the driving wheel 53 is limited for the child's finger to responsively rotate the driving wheels 53 and press down the gas lever 32 at the same time within such tight space right above the gas lever 32.

Figure 5:
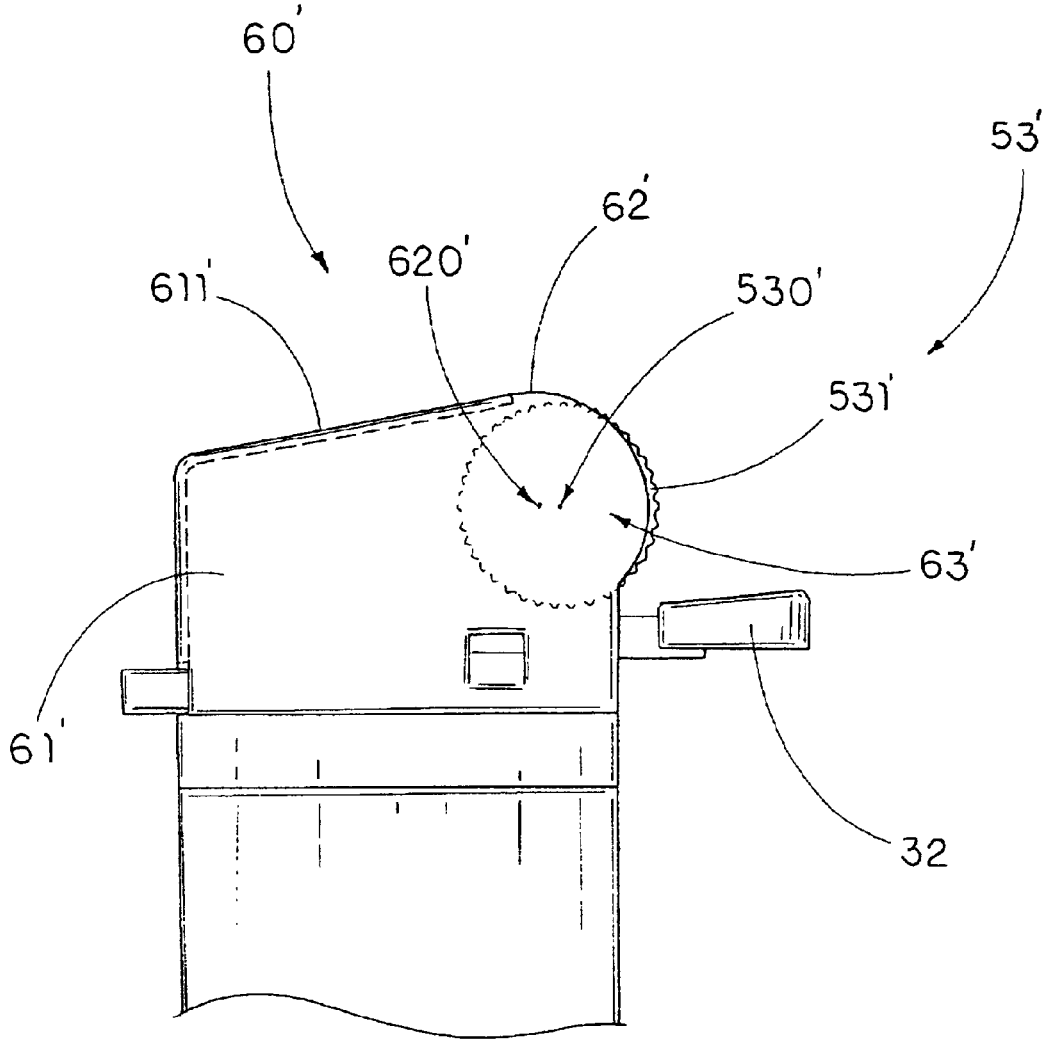
FIG. 5 illustrates a first alternative mode of the shielding frame of the child resistant disposable lighter according to the above preferred embodiment of the present invention.

FIG. 5 illustrates a first alternative mode of the shielding frame 60', which substantially has the same structure of the above preferred embodiment except, instead of the vertical walls, the rear ends of the shielding guards 62 are curved in semi-circular shape to form a pair of rear covers 63' to further encircle the rear portions of the outer sides of the driving wheels 53' respectively. In other words, each of the two shielding guard 62' forms a circular shelter that, when a radius of each of the shielding guards 62' is equal to or slightly smaller than the radius of the driving wheels 53', a small rear edges of the driving wheels 53' may still expose out of the shielding guards 62', i.e. to extend out of the ignition cavity 621', to define the manipulation portions 531' of the driving wheels 53' to function as recited above. Of course, when the radius of the shielding guards 62' is even slightly larger than that of the driving wheels 53', the entire outer sides of the driving wheels 53' will be completely covered by the shielding guards 62' of the shield frame 60' respectively while an adult is still capable of igniting the lighter without difficulty. In other words, each of the slanted top edge rims 611', which is smooth surfaces integrally extended from the front end of the frame body 61' upwardly, rearwardly and inclinedly to a rear end of the frame body 61', further comprises a rear section extended rearwardly, downwardly and curvedly in arc-shaped along the curvature of the rear portion of the respective driving wheel 53'.

Figure 6:
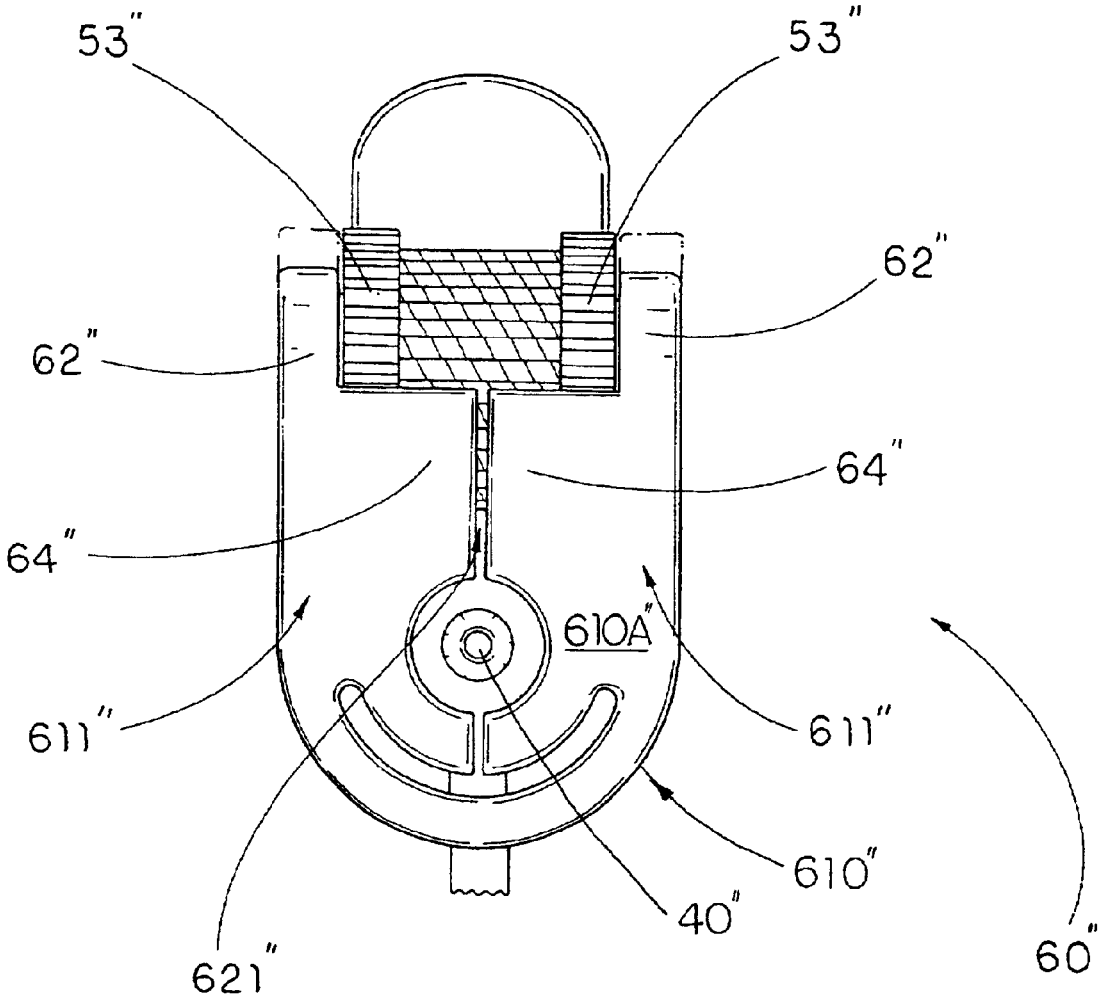
FIG. 6 illustrates a second alternative mode of the shielding frame of the child resistant disposable lighter according to the above preferred embodiment of the present invention.

FIG. 6 illustrates another alternative mode of the above preferred embodiment as shown in FIGS. 2 to 4 and the first alternative mode of the preferred embodiment as shown in FIG. 5, wherein the shielding frame 60" is modified to have an rearwardly lengthened gas shelter 610". Comparing FIG. 6 with FIG. 4, the front portions and two middle portions of the two slanted top edge rims 611" inwardly extend to form an enlarged shelter top 610A" having an additional top cover 64" that it not only shelters the gas nozzle 40" but also covers front and top portions of the top driving edges of driving wheels 53" as illustrated as the dotted lines in FIG. 5.

Therefore, the front portions and part of the top portions of the driving wheels 53" are covered by the top cover 64" so as to further ensure that the child's finger has no way to contact with the front portions of the driving wheels 53". As shown in FIG. 5, it is appreciated that the top cover 64" can be incorporated with the rear cover 63' of the above first alternative in order to enhance the safety purpose of the shielding frame 60" to prevent the child's finger engaging with the driving wheels 53".

What is claimed is:

1. A child resistant disposable lighter, comprising:

a lighter body having a gas reservoir therein;

a supporting frame, provided on top of said lighter body, comprising a first supporting wall and a second supporting wall parallely and longitudinally extended from two sides of said supporting frame respectively, said supporting frame further having a vertical spring chamber provided between said first and second supporting walls;

a spring received in said spring chamber;

a gas lever being pivotally mounted between said first and second supporting walls and having a front lifting end and a depressible end;

a gas nozzle upwardly extended from said gas reservoir at a position above said supporting frame, wherein said gas nozzle is engaged with said lifting end of said gas lever in such a manner that when said depressible end of said gas lever is pressed downwardly, said lifting end of said gas lever pivotally lifts up said gas nozzle to release gas from said gas reservoir through said gas nozzle;

an ignition device, which comprises a flint having a bottom portion inserting into said spring chamber and being supported by said spring, a striker wheel having a circumferential coarse striking surface positioned right above said flint and being rotatably mounted between said first and second supporting walls, and two driving wheels, each having a planar outer facing surface and a diameter larger than a diameter of said striker wheel, coaxially attached at two sides of said striker wheels respectively and arranged in such a manner that when said driving wheels are rotated, said striker wheel is driven to rotate and strike against said flint to produce sparks towards said gas nozzle; and a shielding frame which comprises a U-shaped frame body mounted on said supporting frame, said frame body having two sidewalls positioned at two outer sides of said supporting walls respectively, wherein two front ends of said two sidewalls are inwardly curved to meet and form a gas shelter surrounding said gas nozzle and a top edge of each said sidewall of said frame body bends inwardly to form a slanted top edge rim extended rearwardly, upwardly and inclinedly from a front end to a rear end thereof, wherein rear portions of said two slanted top edge rims and two rear portions of said sidewalls form two shielding guards respectively, wherein said shielding guards encircle and cover bottom portions and top portions of said planar outer facing surfaces of said two driving wheels respectively, wherein an ignition cavity is defined between said two shielding guards to rotatably receive said two driving wheels therein, wherein a center of each of said shielding guards is positioned eccentrically to a center of said respective driving wheel so as to position front portions and top portions of said two driving wheels below said two slanted top edge rims, wherein top circumferential edge of said driving wheels are positioned below said top edge rims respectively, wherein each of said slanted top edge rims forms a predetermined slope tangentially arranged with respect to the outer circumference of said respective driving wheel and rear circumferential edges of said driving wheels form manipulation portions respectively, therefore said two slanted top edge rims of said frame body function as a physical barrier to especially prevent a finger of a child from contacting with said front portions of said driving wheels for preventing the finger of said child from driving said driving wheels to rotate while a finger of an adult is capable of driving said driving wheels to rotate at said manipulation portions of said driving wheels to produce sparks wherein said manipulation portions provide a solid contact of said finger of said adult with said driving wheels immediately before pressing on said gas lever in order to ensure ignition operation.

2. The child resistant disposable lighter, as recited in claim 1, wherein said center of each of said shielding guard is eccentrically positioned in front of said center of said respective driving wheel.

3. The child resistant disposable lighter, as recited in claim 2, wherein said center of each of said shielding guards is further positioned above said center of said respective driving wheel.

4. The child resistant disposable lighter, as recited in claim 3, wherein each of said shielding guards has a radius equal to a radius of said driving wheel.

5. The child resistant disposable lighter, as recited in claim 4, wherein said manipulation portions are exposed out of said shielding guards respectively.

6. The child resistant disposable lighter, as recited in claim 3, wherein said manipulation portions are exposed out of said shielding guards respectively.

7. The child resistant disposable lighter, as recited in claim 6, wherein rear ends of said two shielding guards are curved in semi-circular shape to form a pair of rear covers to further encircle rear portions of said planar outer facing surfaces of said driving wheels respectively, wherein each of said two shielding guard forms a circular shelter and each of said slanted top edge rims further comprises a rear section extended rearwardly, downwardly and curvedly in arc-shaped along a curvature of said rear portion of said respective driving wheel.

8. The child resistant disposable lighter, as recited in claim 6, wherein front portions of said two slanted top edge rims inwardly extend to form a shelter top having a flame opening thereon of said gas shelter, wherein said shelter top is lengthened rearwardly to form an additional top cover to not only shelter said gas nozzle but also cover front circumferential edges and said top circumferential edges of said two driving wheels, therefore, said front circumferential edges and part of said top circumferential edges of said driving wheels are covered by said top cover for further preventing said finger of said child from contacting with said front portions of said driving wheels.

9. The child resistant disposable lighter, as recited in claim 3, wherein rear ends of said two shielding guards are curved in semi-circular shape to form a pair of rear covers to further encircle rear portions of said planar outer facing surfaces of said driving wheels respectively, wherein each of said two shielding guard forms a circular shelter and each of said slanted top edge rims further comprises a rear section extended rearwardly, downwardly and curvedly in arc-shaped along a curvature of said rear portion of said respective driving wheel.

10. The child resistant disposable lighter, as recited in claim 9, wherein front portions of said two slanted top edge rims inwardly extend to form a shelter top having a flame opening thereon of said gas shelter, wherein said shelter top is lengthened rearwardly to form an additional top cover to not only shelter said gas nozzle but also cover front circumferential edges and said top circumferential edges of said two driving wheels, therefore, said front circumferential edges and part of said top circumferential edges of said driving wheels are covered by said top cover for further preventing said finger of said child from contacting with said front portions of said driving wheels.

11. The child resistant disposable lighter, as recited in claim 3, wherein front portions of said two slanted top edge rims inwardly extend to form a shelter top having a flame opening thereon of said gas shelter, wherein said shelter top is lengthened rearwardly to form an additional top cover to not only shelter said gas nozzle but also cover front circumferential edges and said top circumferential edges of said two driving wheels, therefore, said front circumferential edges and part of said top circumferential edges of said driving wheels are covered by said top cover for further preventing said finger of said child from contacting with said front portions of said driving wheels.

12. The child resistant disposable lighter, as recited in claim 2, wherein each of said shielding guards has a radius equal to a radius of said driving wheel.

13. The child resistant disposable lighter, as recited in claim 12, wherein said manipulation portions are exposed out of said shielding guards respectively.

14. The child resistant disposable lighter, as recited in claim 2, wherein said manipulation portions are exposed out of said shielding guards respectively.

15. The child resistant disposable lighter, as recited in claim 14, wherein rear ends of said two shielding guards are curved in semi-circular shape to form a pair of rear covers to further encircle rear portions of said planar outer facing surfaces of said driving wheels respectively, wherein each of said two shielding guard forms a circular shelter and each of said slanted top edge rims further comprises a rear section extended rearwardly, downwardly and curvedly in arc-shaped along a curvature of said rear portion of said respective driving wheel.

16. The child resistant disposable lighter, as recited in claim 14, wherein front portions of said two slanted top edge rims inwardly extend to form a shelter top having a flame opening thereon of said gas shelter, wherein said shelter top is lengthened rearwardly to form an additional top cover to not only shelter said gas nozzle but also cover front circumferential edges and said top circumferential edges of said two driving wheels, therefore, said front circumferential edges and part of said top circumferential edges of said driving wheels are covered by said top cover for further preventing said finger of said child from contacting with said front portions of said driving wheels.

17. The child resistant disposable lighter, as recited in claim 2, wherein rear ends of said two shielding guards are curved in semi-circular shape to form a pair of rear covers to further encircle rear portions of said planar outer facing surfaces of said driving wheels respectively, wherein each of said two shielding guard forms a circular shelter and each of said slanted top edge rims further comprises a rear section extended rearwardly, downwardly and curved in arc-shaped along a curvature of said rear portion of said respective driving wheel.

18. The child resistant disposable lighter, as recited in claim 17, wherein front portions of said two slanted top edge rims inwardly extend to form a shelter top having a flame opening thereon of said gas shelter, wherein said shelter top is lengthened rearwardly to form an additional top cover to not only shelter said gas nozzle but also cover front circumferential edges and said top circumferential edges of said two driving wheels, therefore, said front circumferential edges and part of said top circumferential edges of said driving wheels are covered by said top cover for further preventing said finger of said child from contacting with said front portions of said driving wheels.

19. The child resistant disposable lighter, as recited in claim 2, wherein front portions of said two slanted top edge rims inwardly extend to form a shelter top having a flame opening thereon of said gas shelter, wherein said shelter top is lengthened rearwardly to form an additional top cover to not only shelter said gas nozzle but also cover front circumferential edges and said top circumferential edges of said two driving wheels, therefore, said front circumferential edges and part of said top circumferential edges of said driving wheels are covered by said top cover for further preventing said finger of said child from contacting with said front portions of said driving wheels.

20. The child resistant disposable lighter, as recited in claim 1, wherein said center of each of said shielding guards is positioned above said center of said respective driving wheel.

21. The child resistant disposable lighter, as recited in claim 20, wherein each of said shielding guards has a radius equal to a radius of said driving wheel.

22. The child resistant disposable lighter, as recited in claim 21, wherein said manipulation portions are exposed out of said shielding guards respectively.

23. The child resistant disposable lighter, as recited in claim 20, wherein said manipulation portions are exposed out of said shielding guards respectively.

24. The child resistant disposable lighter, as recited in claim 23, wherein rear ends of said two shielding guards are curved in semi-circular shape to form a pair of rear covers to further encircle rear portions of said planar outer facing surfaces of said driving wheels respectively, wherein each of said two shielding guard forms a circular shelter and each of said slanted top edge rims further comprises a rear section extended rearwardly, downwardly and curvedly in arc-shaped along a curvature of said rear portion of said respective driving wheel.

25. The child resistant disposable lighter, as recited in claim 23, wherein front portions of said two slanted top edge rims inwardly extend to form a shelter top having a flame opening thereon of said gas shelter, wherein said shelter top is lengthened rearwardly to form an additional top cover to not only shelter said gas nozzle but also cover front circumferential edges and said top circumferential edges of said two driving wheels, therefore, said front circumferential edges and part of said top circumferential edges of said driving wheels are covered by said top cover for further preventing said finger of said child from contacting with said front portions of said driving wheels.

26. The child resistant disposable lighter, as recited in claim 20, wherein rear ends of said two shielding guards are curved in semi-circular shape to form a pair of rear covers to further encircle rear portions of said planar outer facing surfaces of said driving wheels respectively, wherein each of said two shielding guard forms a circular shelter and each of said slanted top edge rims further comprises a rear section extended rearwardly, downwardly and curvedly in arc-shaped along a curvature of said rear portion of said respective driving wheel.

27. The child resistant disposable lighter, as recited in claim 26, wherein front portions of said two slanted top edge rims inwardly extend to form a shelter top having a flame opening thereon of said gas shelter, wherein said shelter top is lengthened rearwardly to form an additional top cover to not only shelter said gas nozzle but also cover front circumferential edges and said top circumferential edges of said two driving wheels, therefore, said front circumferential edges and part of said top circumferential edges of said driving wheels are covered by said top cover for further preventing said finger of said child from contacting with said front portions of said driving wheels.

28. The child resistant disposable lighter, as recited in claim 20, wherein front portions of said two slanted top edge rims inwardly extend to form a shelter top having a flame opening thereon of said gas shelter, wherein said shelter top is lengthened rearwardly to form an additional top cover to not only shelter said gas nozzle but also cover front circumferential edges and said top circumferential edges of said two driving wheels, therefore, said front circumferential edges and part of said top circumferential edges of said driving wheels are covered by said top cover for further preventing said finger of said child from contacting with said front portions of said driving wheels.

29. The child resistant disposable lighter, as recited in claim 1, wherein rear ends of said two shielding guards are curved in semi-circular shape to form a pair of rear covers to further encircle rear portions of said planar outer facing surfaces of said driving wheels respectively, wherein each of said two shielding guard forms a circular shelter and each of said slanted top edge rims further comprises a rear section extended rearwardly, downwardly and curvedly in arc-shaped along a curvature of said rear portion of said respective driving wheel.

30. The child resistant disposable lighter, as recited in claim 29, wherein front portions of said two slanted top edge rims inwardly extend to form a shelter top having a flame opening thereon of said gas shelter, wherein said shelter top is lengthened rearwardly to form an additional top cover to not only shelter said gas nozzle but also cover front circumferential edges and said top circumferential edges of said two driving wheels, therefore, said front circumferential edges and part of said top circumferential edges of said driving wheels are covered by said top cover for further preventing said finger of said child from contacting with said front portions of said driving wheels.

31. The child resistant disposable lighter, as recited in claim 1, wherein front portions of said two slanted top edge rims inwardly extend to form a shelter top having a flame opening thereon of said gas shelter, wherein said shelter top is lengthened rearwardly to form an additional top cover to not only shelter said gas nozzle but also cover front circumferential edges and said top circumferential edges of said two driving wheels, therefore, said front circumferential edges and part of said top circumferential edges of said driving wheels are covered by said top cover for further preventing said finger of said child from contacting with said front portions of said driving wheels.

* * * * *